US006537191B1

(12) United States Patent
Stroucken et al.

(10) Patent No.: US 6,537,191 B1
(45) Date of Patent: Mar. 25, 2003

(54) CENTRIFUGAL SEPARATOR

(75) Inventors: Klaus Stroucken, Rönninge (SE); Rolf Ridderstråle, Stockholm (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/701,153

(22) PCT Filed: Jun. 14, 1999

(86) PCT No.: PCT/SE99/01053

§ 371 (c)(1),
(2), (4) Date: Nov. 22, 2000

(87) PCT Pub. No.: WO99/65610

PCT Pub. Date: Dec. 23, 1999

(30) Foreign Application Priority Data

Jun. 15, 1998 (SE) ..... 9802116

(51) Int. Cl.[7] ..... B04B 1/20; B04B 9/08; B04B 11/02

(52) U.S. Cl. ..... 494/53; 494/64; 494/70; 494/84

(58) Field of Search ..... 494/45, 46, 52–54, 494/56, 62, 64, 68–70, 84; 210/380.1; 74/640, 665 F, 665 K

(56) References Cited

U.S. PATENT DOCUMENTS 1,572,299 A * 2/1926 McEntire
1,780,655 A * 11/1930 Nyrop
1,806,241 A * 5/1931 Dupuis
1,999,712 A * 4/1935 Zorn et al.
2,043,409 A * 6/1936 Heitmann
2,129,992 A * 9/1938 De Mattia
2,435,623 A * 2/1948 Forsberg
2,458,706 A * 1/1949 Howe
2,711,854 A * 6/1955 Kjellgren
2,907,517 A * 10/1959 Ziherl
2,919,848 A * 1/1960 Howe
3,061,181 A * 10/1962 Gooch
3,081,026 A * 3/1963 Lacker et al.
3,092,582 A * 6/1963 Lacker
3,161,081 A * 12/1964 Musser
3,228,592 A * 1/1966 Shapiro
3,228,596 A * 1/1966 Reed
3,407,902 A * 10/1968 Musser
3,424,375 A * 1/1969 Maurer
3,487,722 A * 1/1970 Cline
3,595,469 A * 7/1971 Stoferie
4,009,823 A * 3/1977 Nozdrovsky
4,042,172 A * 8/1977 Nozdrovsky
4,154,394 A * 5/1979 Reed
4,673,491 A * 6/1987 Sedlaczek
4,715,247 A * 12/1987 Honda et al.
5,123,300 A * 6/1992 Himmelein et al.
5,269,202 A * 12/1993 Kiyosawa et al.
5,277,809 A * 1/1994 Eder
5,494,579 A * 2/1996 Robatel et al.
5,772,573 A * 6/1998 Hao
6,056,685 A * 5/2000 Nelson

FOREIGN PATENT DOCUMENTS

JP 9-215946 * 8/1997

* cited by examiner

*Primary Examiner*—Charles E. Cooley
(74) *Attorney, Agent, or Firm*—McCormick, Paulding & Huber LLP

(57) ABSTRACT

In a centrifugal separator for separating solids from a liquid mixture in which the solids in the form particles are suspended in a liquid having a density less than that of the particles the centrifugal separator includes a rotor rotatable at a first speed. A screw conveyor is arranged in and coaxial with the rotor and rotates at a second speed differing from the first speed. A drive device is adapted for rotation of the rotor at the first speed and the screw conveyor at the second speed. The rotor is totally supported at one end only through a rotor shaft that is arranged so that the rotor central axis extends substantially vertically. The rotor includes an inlet for the mixture, in the form of at least one inlet channel which extends into the rotor at one end and a liquid outlet for separated liquid, in the form of at least one outlet channel which extends out of the rotor at one end, and a sludge outlet for separated solids situated at an opposite end of the rotor. The rotor includes a conical portion at the apex of which the sludge outlet is positioned.

28 Claims, 6 Drawing Sheets

CENTRIFUGAL SEPARATOR

FIELD OF THE INVENTION

The present invention relates to a centrifugal separator for separation of solids from a liquid mixture, in which particles of this kind are suspended in a liquid having a density smaller than that of the particles. Particularly, the invention concerns a so-called decanter centrifuge, which includes a rotor having a center axis around which it is rotatable at a first speed, a screw conveyor, which is arranged in the rotor and is rotatable around said center axis at a second speed differing from said first speed, and a driving device adapted for rotation of the rotor at said first speed and the screw conveyor at said second speed.

BACKGROUND OF THE INVENTION

Decanter centrifuges of this kind are used in many different applications, especially where the mixture to be treated has a relatively large content of solids. Decanter centrifuges are used also in applications where the particles to be separated have a greatly varying size and/or where the content of particles in the mixture varies greatly. Furthermore, it is common to use decanter centrifuges in applications where relatively large volumes of liquid are treated, which means that decanter centrifuges as a rule are relatively large, so that they may give a satisfactory separation result despite large flows per unit of time of a supplied mixture.

Irrespective of the amount of mixture supplied per unit of time it is a desire for each centrifugal separator, independent of type, that it should provide a satisfactory separation result independently of whether the supplied liquid mixture has a relatively large or a relatively small content of solids. Thus, it is desirable that a centrifugal separator dimensioned for a certain through flow of liquid to be treated may be used under different conditions, i.e. both in conditions where the content of solids is large and under conditions where the content of solids is small. If the centrifugal separator has to be modified in order to give a satisfactory separation result in one condition or another, it should have a construction making such a modification possible in an inexpensive and simple way.

This is a problem with previously known decanter centrifuges, i.e. they have a construction which does not make a simple and inexpensive modification possible so the centrifuge becomes efficient, i.e. gives a satisfactory separation result, under different conditions.

It has become a consequence of this problem that, instead of decanter centrifuges, centrifugal separators of other kinds have been used under conditions where the mixture to be treated has had a relatively small flow per unit of time and an although relatively small but still not insignificant content of solids. Then, in certain cases, it has been possible to use so-called nozzle separators, but if the content of particles in the mixture, or the size of the particles, has varied heavily, nozzle separators have not been suitable. Instead, for this kind of separation cases, it has been necessary to use centrifugal separators, which are adapted for intermittent discharge of separated particles. However, other problems have then arisen, since centrifugal separators of this kind have a very limited ability to discharge separated solids during operation. Thus, it has either been necessary to perform sludge discharge operations at a very large frequency during the operation of the centrifugal separator, which has made an effective separation difficult, or it has been necessary to reduce the amount of mixture supplied to the centrifugal separator per unit of time, which has rendered the capacity of the centrifugal separator to be much too small. In both cases it has often been necessary to overdimension the centrifugal separator to obtain an acceptable separation efficiency, i.e. a satisfactory separation result, or an acceptable separation capacity.

In other connections, where a liquid to be treated has had a relatively large flow per unit of time and a relatively small content of solids, decanter centrifuges have been used, since use of centrifugal separators of a different kind has not been possible from a cost point of view. In these cases it has been necessary, however, to overdimension the decanter centrifuges so that they would give a desired separation result. Thus, it has not been possible to design a decanter centrifuge in an optimum way for treatment of a mixture having a relatively small content of solids.

Based on the foregoing, it is the general object of the present invention to provide a design or construction for decanter centrifuges which overcomes the problems and drawbacks of the prior art.

A primary object of the present invention is to provide a design or construction for decanter centrifuges, which is of a kind such that a decanter centrifuge relatively simply and inexpensively may be adapted for operation in connections where the mixture to be treated has a large content of solids as well as in connections where this content is small, so that a desired separation result is achieved.

Another object of the invention is that the design in question should make possible production of decanter centrifuges at a low cost.

SUMMARY OF THE INVENTION

The above defined objects may be obtained according to the invention by a design for a centrifugal separator of the initially defined kind, which is characterised by the combination that

- the rotor is rotatably supported only at its one end through a rotor shaft, which is arranged such that the center axis of the rotor extends substantially vertically,
- the rotor has an inlet for said mixture in the form of at least one inlet channel, which extends into the rotor at its said one end, a liquid outlet for separated liquid in the form of at least one outlet channel, which extends out of the rotor at its said one end, and a sludge outlet for separated solids situated at the opposite other end of the rotor,
- the rotor includes a conical portion, at the apex of which the said sludge outlet is situated,
- the screw conveyor is formed for transportation of the separated solids through said conical portion of the rotor towards the sludge outlet, and
- the screw conveyor has or is connected with a conveyor shaft, which extends axially through the rotor shaft and is coupled to said driving device.

Thanks to this combination according to the invention said sludge outlet may be positioned at any desired distance from the rotor center axis all the way into this center axis.

A first advantage of the present invention is that it makes possible a dimensioning of a decanter centrifuge outgoing from the amount of solids to be discharged through the sludge outlet per unit of time. This means that a decanter centrifuge according to the invention, which is intended for a certain flow per unit of time of the mixture to be treated, may be given a desired separation ability without being overdimensioned, independently of the content of solids of the mixture.

A second advantage of the invention is that the sludge outlet of the rotor may be moved by simple means towards or away from the rotor center axis for adaptation of the decanter centrifuge to different needs or in connection with investigations for determination of the most suitable location of the sludge outlet in a special separation case.

A third advantage of the invention is that is suitable for relatively small decanter centrifuges, i.e. decanter centrifuges which may be used for treatment of liquid mixtures having a relatively small flow per unit of time. In small decanter centrifuges of this kind the sludge outlet may be formed as a very small opening at the apex of the conical rotor portion, i.e. at the innermost part of it at the rotor center axis, whereby the surrounding wall of the rotor may be given the smallest possible diameter. Hereby, the invention may be used in flow areas where conventional decanter centrifuges have not previously been used.

Small decanter centrifuges designed according to the invention may be produced very inexpensively, because many parts thereof may be produced for instance of plastics or light metal. A consequence thereof is that it may sometimes be suitable to use several relatively small decanter centrifuges designed according to the invention giving a desired separation result, instead of one or a few large conventional decanter centrifuges, which despite their size would still not give a desired separation result or which due to overdimensioning would be unnecessarily expensive to produce.

Preferably, said conical portion of the rotor has the shape of a hollow truncated cone, which at its narrow end forms an axially directed central opening, the sludge outlet of the rotor being formed by this opening. Upon change of the radial position of the sludge outlet either the hollow truncated cone may be exchanged in its entirety or a piece may be applied or removed from the narrow end of the hollow cone. If desired, the screw conveyor may be made so long that it extends out through the central opening, if the sludge outlet is to be situated relatively far from the rotor center axis. Alternatively, even the end portion of the screw conveyor may be exchangeable for screw pieces of different lengths.

Since the rotor is rotatably supported only at its upper end, i.e. the supporting device for the rotor has no bearing at a certain level in the area of the lower end of the rotor, the rotor, if desired, may be provided with a different conical portion, which is longer or shorter than the original conical portion, and a different screw conveyor adapted thereto. This may be desirable, for instance, if the consistency of the sludge to be separated in the rotor would require in a certain connection a more or less steep inclination relative to the rotational axis of the rotor when transported by means of the screw conveyor towards the sludge outlet in the conical portion of the rotor.

As said previously, the design according to the invention is of a kind such that the sludge outlet of the rotor may be placed very close to the rotational axis of the rotor. This also means that the free liquid surface, which is formed within the rotor during operation, may be kept relatively close to the rotational axis of the rotor, and this in turn makes possible that a separation efficiency improving insert of separation discs, e.g. conical separation discs, may be arranged within the rotor and have relatively small radial dimensions.

The possibility given by the invention for an arrangement of the sludge outlet very close to the rotational axis of the rotor may alternatively be used in a way such that separated sludge is given an extra long way of transportation along a liquid-free part of the conical portion of the rotor. In certain separation cases this may be desirable for the achievement of a sludge as dry as possible. In a preferred embodiment of the invention the rotor shaft and the conveyor shaft are coupled together through a gear device, which includes three co-operating gear members, of which a first gear member is connected with the rotor shaft and a second gear member is connected with the conveyor shaft, said three gear members being adapted for rotation relative to each other around a prolongation of the rotor centre axis and said inlet channel extending centrally through the gear device.

This gear device may be a planetary gear device, but preferably it is constituted by a so-called Harmonic Drive gear device (HD gear device) including a stiff cylindrical gear member, which is rotatable around its center axis and has a first number of cogs or teeth distributed around this central axis, a flexible gear member, which extends around the same center axis and has a different number of cogs or teeth, which are distributed around the center axis and which are adapted gradually to be brought into and out of engagement with the cogs or teeth of the cylindrical gear member, and a wave generator which is adapted gradually to deform the flexible gear member and, thereby, accomplish said cog engagement between the gear members. Upon use of an HD gear device a very compact gear device can be obtained despite the previously mentioned inlet channel extending centrally therethrough. An HD gear device has previously been suggested for use in a decanter centrifuge (see U.S. Pat. No. 3,419,211 and U.S. Pat. No. 3,482,770). However, in that connection no inlet channel for mixture to be treated in the decanter centrifuge has extended centrally through the HD gear device.

The advantages of the design according to the invention may be used to a maximum if the screw conveyor and the rotor are not provided with any particular bearing device in the area of the sludge outlet. This is possible if the screw conveyor is journalled through its conveyor shaft at two axially spaced places in the rotor shaft, through which the conveyor shaft extends. It is also possible if the screw conveyor is allowed to abut by its conveyor flights against the inside of the rotor, e.g. in the conical portion of the rotor. If the screw conveyor and/or the rotor are made of plastics, an abutment of this kind may serve as journalling for the screw conveyor, at least in connection with starting of the rotation of the rotor and the screw conveyor. During normal operation, when the screw conveyor is loaded axially as a consequence of its transportation of sludge relative to the rotor, a certain small radial play may be allowed to come up between the rotor and the screw conveyor.

It is alternatively possible to use the technique which can be seen from U.S. Pat. No. 4,828,541 and according to which the screw conveyor is journalled relative to the rotor only at its one end and for the rest is formed in a way such that it may float on the liquid present in the rotor during operation. If the screw conveyor, as mentioned earlier, is made of plastics, it will in many cases, just as a consequence thereof, be floating on the liquid present in the rotor during operation.

A Vertical arrangement for decanter centrifuges has previously been suggested, for instance in U.S. Pat. No. 2,862,658 and U.S. Pat. No. 5,364,335. However, each one of the decanter centrifuges disclosed in these patents does not have the whole combination of different design features, which constitutes the present invention. Thus, in the decanter centrifuge according to U.S. Pat. No. 2,862,658 part of the rotor sludge outlet opening in the conical rotor portion is occupied by two stationary pipes; one inlet pipe for mixture to be treated in the rotor and one outlet pipe for a separated liquid fraction. These two pipes make impossible a form of both the rotor and the screw conveyor such that the sludge outlet can be placed very close to the rotor center axis. Also at the decanter centrifuge according to U.S. Pat. No. 5,364,335 it is impossible to locate the sludge outlet very close to the rotor center axis, since in this case the rotor and the screw conveyor are interconnected through a gear box at the apex of the conical portion of the rotor. Thus, none of these known decanter centrifuges, having a vertical rotational axis, has a design fulfilling the previously mentioned primary object of the present invention.

Within the scope of the invention it is also possible to use the technique described in U.S. Pat. No. 3,795,361 and U.S. Pat. No. 3,934,792. In accordance with this technique the screw conveyor is provided with a flange or a partition, which divides the interior of the rotor into two chambers; one separation chamber closest to the liquid outlet and one sludge outlet chamber closest to the sludge outlet. Said partition leaves closest to the surrounding wall of the rotor a narrow slot, which connects the separation chamber with the sludge outlet chamber. By proper setting of the relative speed between the rotational movements of the screw conveyor and the rotor, respectively, separated sludge may be transported through this slot during the operation of the centrifugal separator at a speed such that the slot is constantly kept blocked by sludge. Thereby, the sludge prevents a free flow of unseparated liquid from the separation chamber into the sludge outlet chamber.

If desired, a free liquid surface may be maintained in the separation chamber at a level radially very close to or even radially inside the level of the sludge outlet. Hereby, separated sludge in the radially outermost part of the separation chamber may be subjected to an increased hydraulic pressure from the liquid in the separation chamber, which may act compressing on the sludge. Simultaneously, a hydraulic force is obtained from the liquid in the separation chamber, which contributes to the passage of the sludge through the aforementioned slot from the separation chamber to the sludge outlet chamber.

Depending upon the consistency of the sludge entering the sludge outlet chamber this chamber will contain a larger or smaller amount of sludge during the operation of the decanter centrifuge. If the sludge is relatively dry, the screw conveyor may displace it gradually towards and out through the sludge outlet. If the sludge is relatively wet or contains parts more liquid than solid, the whole of the sludge outlet chamber may be filled with sludge. If so, the screw conveyor may transport relatively solid parts of the sludge closest to the surrounding wall of the rotor, whereas liquid or semi-liquid parts of the sludge will run out through the sludge outlet.

A further advantage can be achieved by use of a partition of the kind described above as a consequence of the fact, as mentioned, that a free liquid surface can be maintained in the separation chamber radially inside the sludge outlet. This makes it possible, namely, that separation discs, e.g. a set of conical separation discs, may be arranged very centrally in the centrifugal rotor. Separation discs of this kind thereby may be made relatively small and they will then become inexpensive to produce. The separation discs may be mounted for rotation either together with the rotor or together with the screw conveyor.

Separation discs, e.g. conical separation discs, are desirable particularly when the mixture to be treated contains small and only with difficulty separable particles. Upon treatment of a mixture of this type it is in addition often difficult to obtain a separated sludge having a large dry substance content. The use of a partition of the above described kind as well as a set of separation discs, e.g. conical separation discs, may give a combination effect for the achievement of a desired separation result in separation cases like this.

A partition of the said kind may be formed and arranged in different ways. For instance, it may be formed as a plane annular disc, which is connected with the screw conveyor and is arranged coaxially therewith. It may be placed in the conical portion of the rotor or, if the rotor also has a cylindrical portion, preferably in the area where the conical portion is connected with the cylindrical portion.

Alternatively, the partition may extend substantially in an axial plane, in which also the rotational axis of the screw conveyor extends, and bridge the gap between two axially adjacent parts of one conveyor flight of the screw conveyor. In a case like this, part of the conveyor flight itself forms part of the partition separating the separation chamber of the rotor from the sludge outlet chamber.

BRIEF DESCRIPTION OF THE DRAWINGS

The invention will be further described in the following with reference to the accompanying drawing, which in FIG. 1 shows a centrifugal separator designed according to a first embodiment of the invention and includes a rotor, a screw conveyor in the rotor and a part of a driving device for rotation of the rotor and the screw conveyor.

DETAILED DESCRIPTION OF THE PREFERRED EMBODIMENTS

Figure 1:
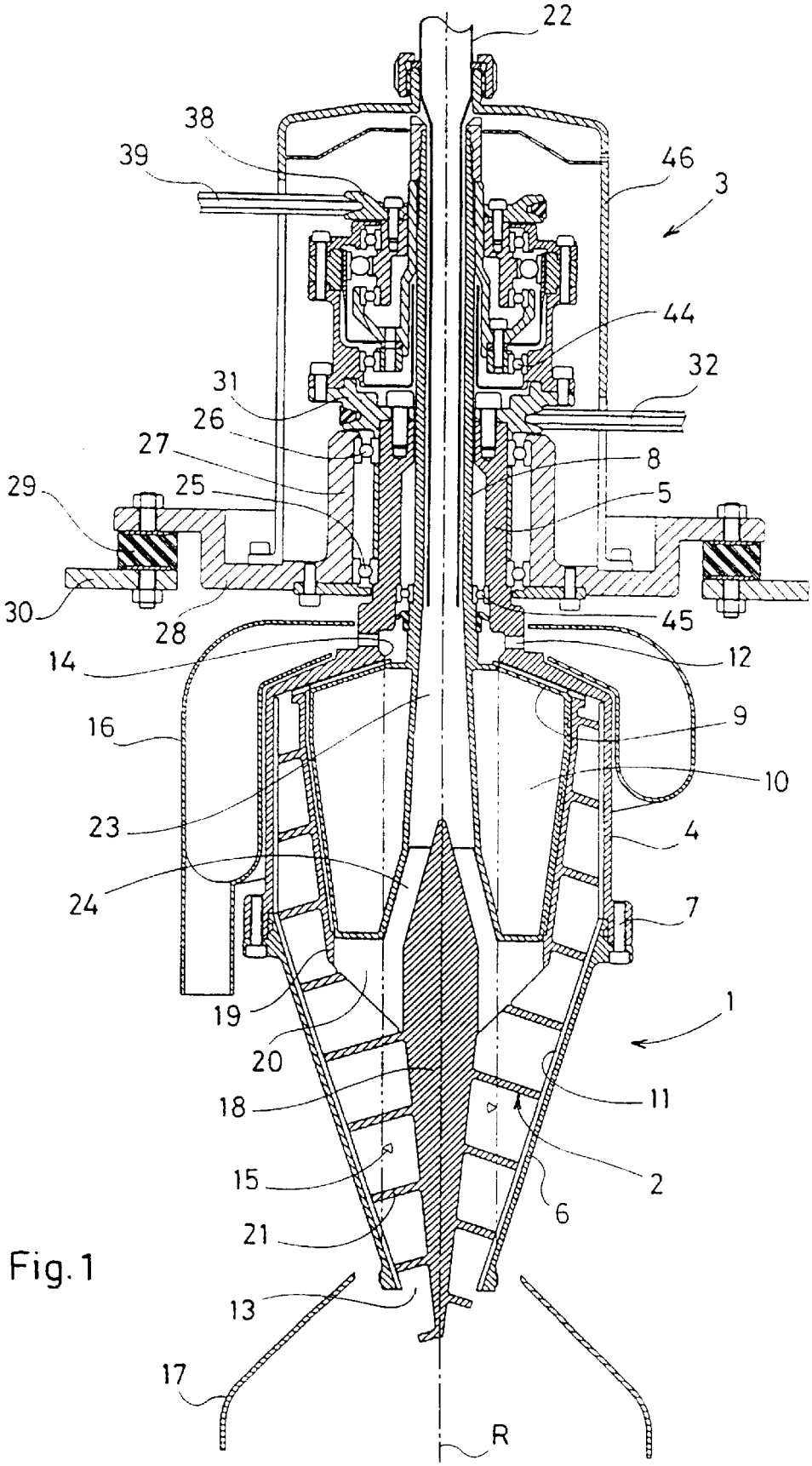
Figure 2:
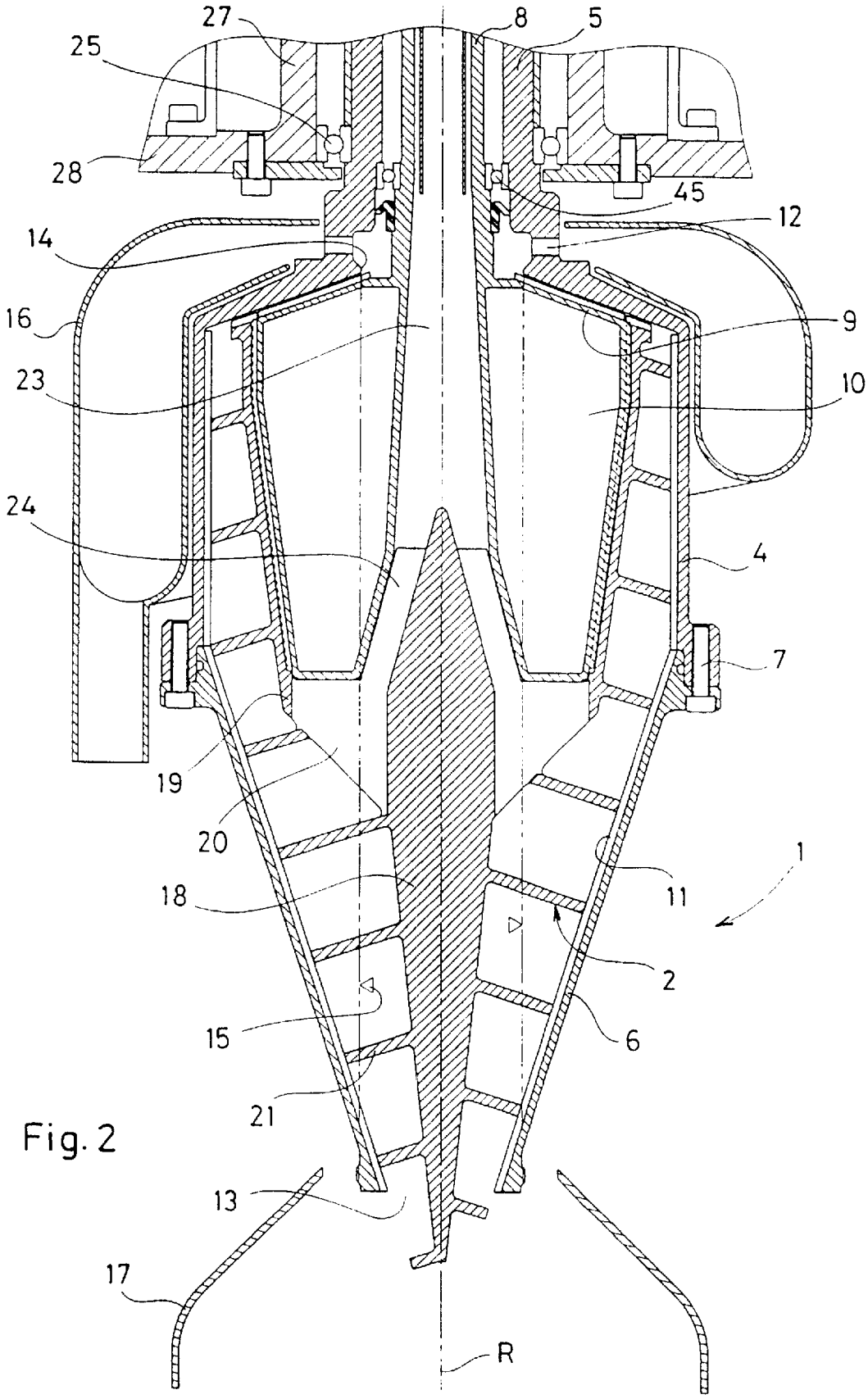
FIG. 2 shows the rotor and the screw conveyor of the centrifugal separator in FIG. 1 on a larger scale.
Figure 3:
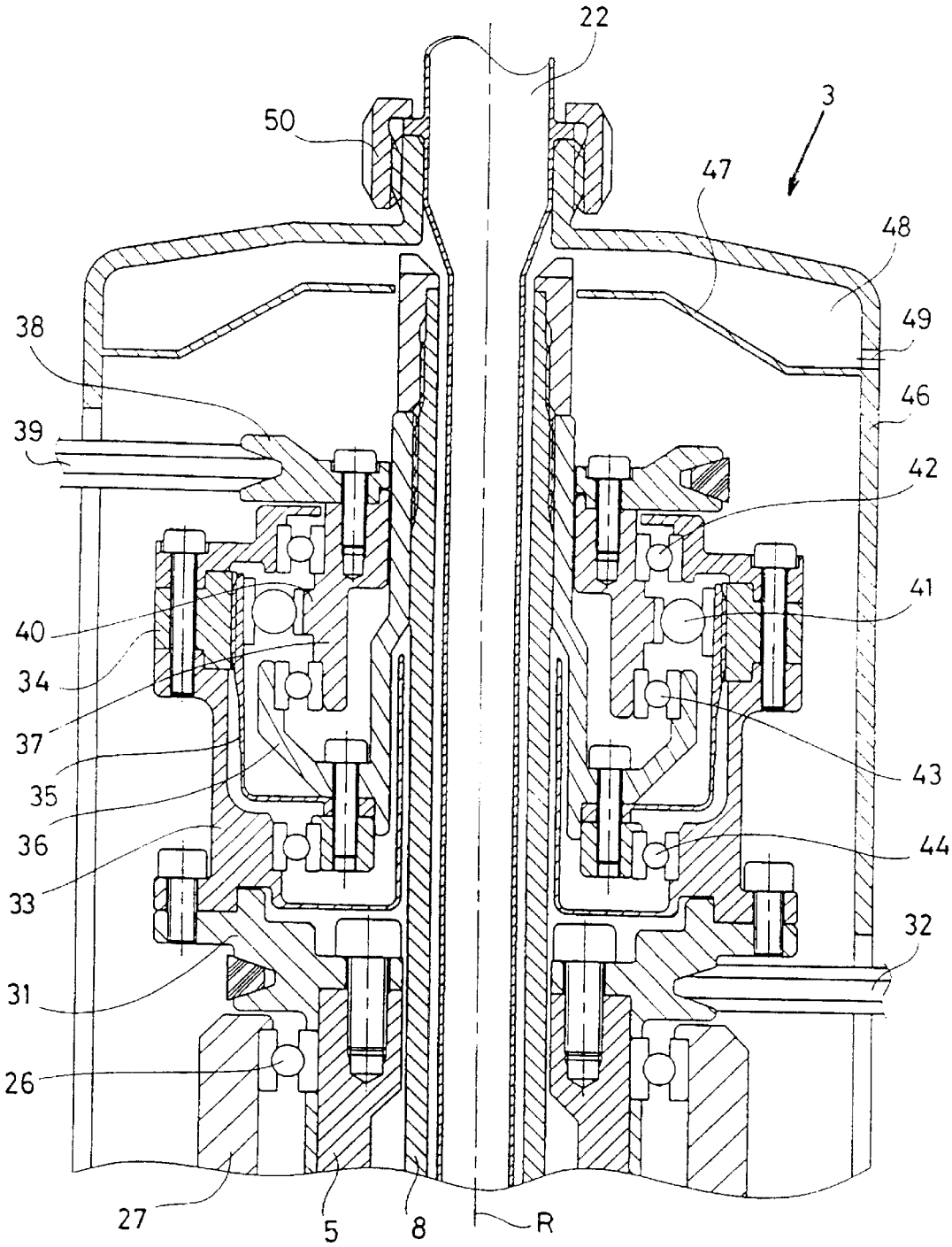
FIG. 3 shows the part of a driving device shown in FIG. 1 on a larger scale.

The FIGS. 1–3 show a first embodiment of the invention. The centrifugal separator includes a rotor 1, which is rotatable at a certain speed around a vertical rotational axis R, a screw conveyor 2 arranged in the rotor 1 and rotatable around the same rotational axis R, however at a speed differing from the rotational speed of the rotor 1, and a driving device adapted for rotation of the rotor 1 and the screw conveyor 2 at their respective speeds. The driving device includes one or more motors (not shown) and a gear device 3, which connects the motor or the motors with the rotor 1 and the screw conveyor 2.

The rotor 1 has a partly cylindrical upper rotor portion 4, which includes or is connected with a hollow rotor shaft 5, and a conical lower rotor portion 6. The rotor portions 4 and 6 are releasably connected with each other by means of bolts 7. Alternative connection members can of course be used.

From above a further hollow shaft 8 extends into the rotor 1 through the interior of the rotor shaft 5. The shaft 8 supports within the rotor an annular body 9, which encloses a space 10. The space 10 is preferably completely closed and may be filled by a material having a relatively low density, such as cellular plastic or the like, for making it impossible that the space would be filled up with liquid if a hole would come up in the surrounding wall of the body 9. On its outside the body 9 has axially extending splines, which are in engagement with corresponding splines formed on a surface of the screw conveyor 2 facing towards the rotational axis R. Thus, the hollow shaft 8 is drivingly connected with the screw conveyor 2 through the body 9 and will be called a conveyor shaft in the following.

In the drawing the conveyor shaft 8 and the body 9 are formed in one piece, which of course is not necessary. Advantageously the body 9 is made from some plastic material, and also the screw conveyor 2 may be made of plastics. Upon mounting of the screw conveyor 2 and the body 9 together, the former is moved axially upwardly relative to the latter, until a snap lock device (not shown) at the upper end of the screw conveyor is automatically brought to fix the screw conveyor relative to the body 9. A snap lock device of this kind is not necessary but may facilitate mounting of the rotor.

The rotor 1 is lined internally by an exchangeable liner 11 of plastics, which may be formed in one piece or consist of different parts, e.g. one cylindrical part for the upper rotor portion 4 and a lower part for the lower rotor portion 6. The liner 11 on its inside has interspaced ribs or grooves distributed around the rotational axis R and extending either axially or helically by some desired pitch relative to the rotational axis R. Since the liner 11 is exchangeable, the rotor for each relevant separation case may be provided with a liner, in which said ribs and grooves are shaped to an optimum, i.e. have desired widths, heights and depths, respectively.

The rotor 1 at its upper end has one or more outlets 12 for liquid and at its lower end a central and axially directed outlet 13 for sludge. In the area of the liquid outlet 12, somewhat below that, the rotor 1 has a radially inwardly directed annular flange 14, which forms an overflow outlet for liquid in the rotor flowing towards and out through the outlet 12. The flange 14 is adapted to maintain a free liquid surface in the rotor 1 at a radial level 15.

Liquid flowing within the rotor towards the outlet 12 has to follow a helical path between the flights of the screw conveyor 2 radially outside the annular body 9. However, the said flights, if desirable, may be provided with through holes for axial flow of liquid. On its axially upwardly directed surface the body 9 has radially extending wings, between which the liquid may flow towards the rotational axis R on its way towards the outlet 12.

At its upper end the rotor 1 is surrounded by a device 16 for catching liquid leaving the rotor through the outlets 12, and at its lower end the rotor is surrounded by a device 17 for catching sludge leaving through the outlet 13.

As can be seen from FIG. 1, the screw conveyor includes a central core 18, which extends axially through the whole of the lower rotor portion 6 and somewhat outside the sludge outlet 13, a sleeve-formed part 19, which surrounds and is releasably connected with the annular body 9, a number of wings 20, which are distributed around the rotor axis R and connect the core 18 with the sleeve-formed part 19, and a conveyor flight 21, which extends helically along the whole inside of the rotor from its upper to its lower end and is connected in turn with the sleeve-formed part 19, the wings 20 and the core 18.

The screw conveyor may be made in one piece of plastic material, possibly fibre-reinforced such material. The core 18 may be made hollow, if desired, the cavity—like the space 10 in the body 9—being possibly filled with some material having a relatively low density, such as cellular plastic or the like.

An inlet pipe 22 for a liquid mixture to be treated in the rotor extends through the conveyor shaft 8. The inlet pipe 22 opens into the conveyor shaft 8 somewhat above the annular body 9. Below the inlet pipe 22 the conveyor shaft 8 and the annular body 9 form a passage 23 constituting a continuation of the inlet channel extending through the inlet pipe 22. The passage 23 communicates through channels 24 between the wings 20 with the interior of the rotor 1 below the annular body 9.

The rotor 1 is supported through the rotor shaft 5 by two axially separated bearings 25 and 26, respectively. These bearings are supported in turn by a sleeve 27, which is firmly connected with a plate 28. The plate 28 is supported through resilient elements 29 by a frame 30. The rotor shaft 5 supports a belt pulley 31, around which a driving belt 32 extends.

FIG. 3 shows the gear device 3 in detail and how it co-operates with the rotor 1 and the screw conveyor 2. The gear device 3 is constituted by a so-called Harmonic Drive gear device (HD gear device) of the kind shown in U.S. Pat. No. 3,419,211 and comprises a stiff cylindrical first gear member 33, which is firmly connected with the pulley 31 and, thereby, is also firmly connected with the rotor shaft 5. The cylindrical gear member 33 has internal cogs or teeth, which are formed on the inside of a ring 34, which constitutes a part of the gear member 33. A second gear member 35 is situated radially inside of the first gear member 33 and includes a thin flexible sleeve. The gear member 35 is supported through a supporting member 36 by the conveyor shaft 8 and has on the flexible sleeve external cogs or teeth situated opposite to said internal cogs or teeth on the ring 34 of the surrounding first gear member 33. In an unloaded state the teeth-provided flexible sleeve is circular-cylindrical and it has a smaller pitch diameter than the teeth-provided ring 34. Thus, the flexible sleeve has a smaller number of teeth than the ring 34. The gear device also includes a third gear member in the form of a so-called wave generator 37, which surrounds the rotational axis R and supports a belt pulley 38. A belt 39 extends around the belt pulley 38. The wave generator 37 as well as the belt pulley 39 surround by a certain play a central part of the supporting member 36 and, thus, are rotatable relative thereto.

The wave generator 37 has an elliptically formed surrounding portion provided with two end portions or protuberances 40 placed diametrically each on one side of the rotational axis R, said protuberances being dimensioned such that they locally deform the flexible sleeve 35, i.e. said second gear member, so that the external teeth of the sleeve 35 are kept locally in engagement with the internal teeth of the surrounding stiff first gear member 33, i.e. the ring 34. Other parts of the gear members 33 and 35 are situated radially spaced from each other in the areas of their respective teeth and, thus, are not in engagement with each other more than in the areas of the protuberances 40.

Between the respective protuberances 40 of the wave generator 37 and the flexible sleeve 35 there are shown balls 41 in FIG. 3. These balls 41 are two out of several balls included in a ball bearing, which surrounds the wave generator 37 and, thus, is also ellipse-formed. Upon rotation of the wave generator 37 relative to the flexible sleeve 35, or vice versa, the protuberances 40 will successively press, through the balls in the ball bearing, the external teeth of the sleeve 35 into engagement with the internal teeth of the stiff cylindrical first gear member 33. Due to the fact that the number of external teeth on the flexible sleeve 35 is smaller than the number of internal teeth on the surrounding stiff ring 34, the sleeve 35—upon rotation of the wave generator 37 relative to the ring 34 in a certain direction around the rotational axis R—will move in the opposite direction around the rotational axis R relative to the ring 34. In other words, if the rotor 2 is rotated by means of the drive pulley 32 around the rotational axis R and the screw conveyor 2 is entrained in this rotation by teeth engagement between the ring 34 and the sleeve 35, a relative movement, i.e. a difference in rotational speed, between the rotor 1 and the screw conveyor 2 may be accomplished by means of the belt 39 by rotation of the wave generator 37 around the rotational axis R at a speed differing from that by which the wave generator is entrained by the rotor.

As can be seen from FIG. 3, the wave generator 37 is journalled in the first gear member 33 by means of a bearing 42 and in the supporting member 36 for the second gear member 35 by means of a bearing 43. A further bearing 44 is arranged between the just mentioned supporting member 36 and the first gear member 33. Finally, as can be seen from FIG. 1, another bearing 45 is arranged between the conveyor shaft 8 and the surrounding rotor shaft 5. The bearings 44 and 45 (se FIG. 1) constitute the two bearings by means of which the screw conveyor 2 is journalled in the rotor 1.

The gear device 3 is surrounded by a cap 46 having openings for the belts 32 and 39. Within the upper part of the cap 46 a chamber 48, which is delimited by a partition 47, is provided with a drainage hole 49 through the cap 46. By means of a lock ring 50 the inlet pipe 22 is fixed to the cap 46. The inlet pipe 22 extends like the conveyor shaft 8 centrally through all of the three gear members 33, 35 and 37.

The decanter centrifuge in the FIGS. 1–3 operates in the following manner.

By means of the belts 32 and 39 the belt pulleys 31 and 38 are kept in rotation around the rotational axis R in the same rotational direction but with somewhat different angular velocities. Thereby, the rotor 1 and the screw conveyor 2 are kept in rotation at somewhat different rotational speeds.

A mixture of liquid and particles suspended therein, having a larger density than the liquid, is supplied to the rotor from above through the inlet pipe 22. The mixture flows through the passage 23 and the channels 24 into the rotor, in which it is brought into rotation. A free liquid surface is formed after a while in the rotor at the level 15, the position of which is determined by the overflow outlet 14 at the upper end of the rotor. While the liquid flows helically around the annular body 9 and out through the liquid outlet 12, separated solids deposit on the inside of the surrounding wall of the rotor. By the screw conveyor particles of this kind are transported in the form of a sludge along the surrounding wall downwardly towards and out through the rotor sludge outlet 13.

A distance above the sludge outlet 13 the solids will leave the liquid body present in the rotor and be transported further on towards the sludge outlet 13 on a dry part of the rotor surrounding wall. The length of the path, along which the solids are to be transported without any contact with the liquid body in the rotor, may be chosen by exchange of the conical lower rotor portion 6. The same screw conveyor may be used for many different rotor portions 6. Instead of exchange of the whole lower rotor portion 6, a different cone of a desired size may be applied at the apex end of the rotor portion 6 (see also the FIGS. 4 and 5).

Figure 4:
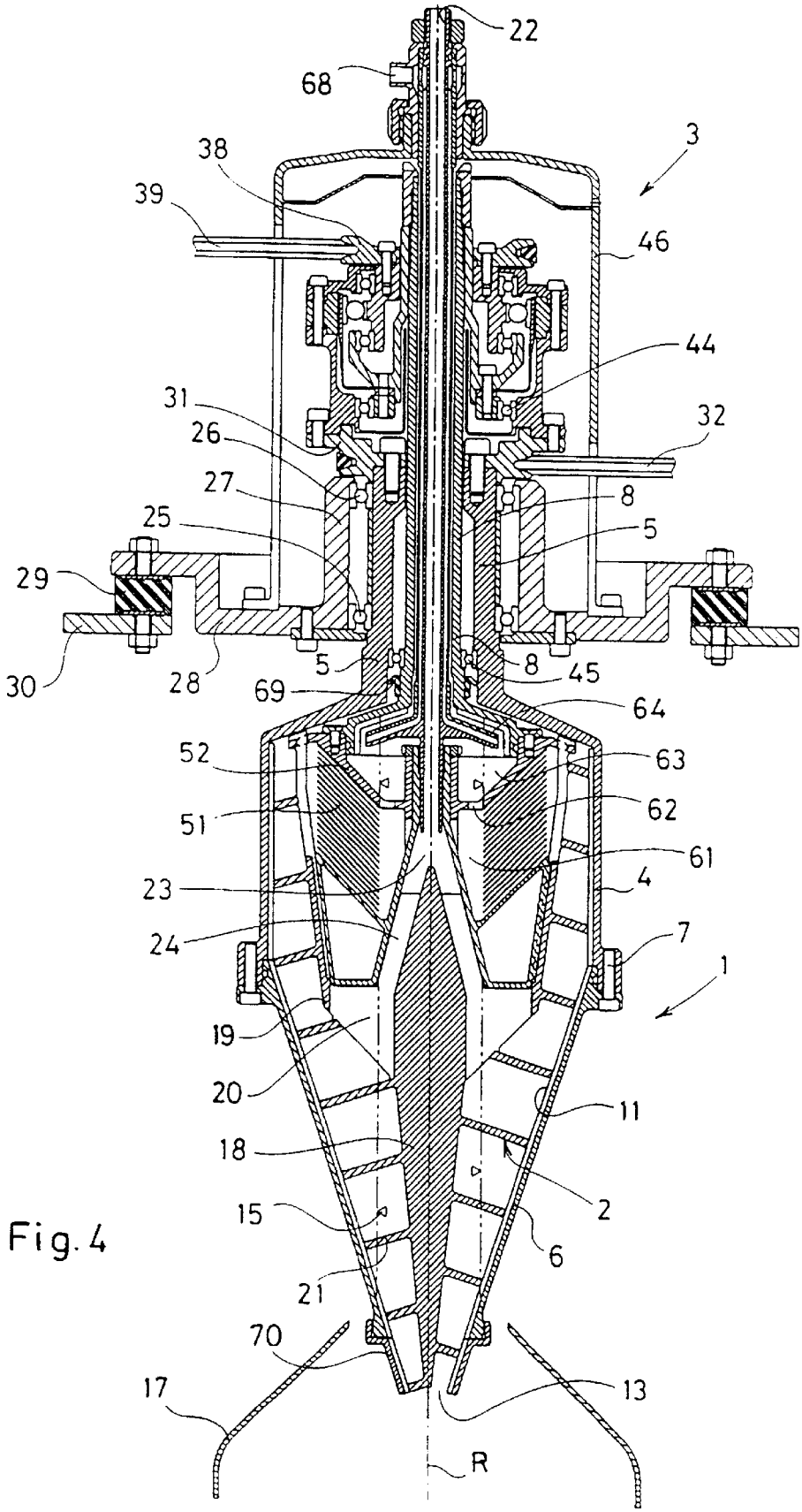
FIG. 4 shows a centrifugal separator designed according to a second embodiment of the invention in a view similar to that in FIG. 1
Figure 5:
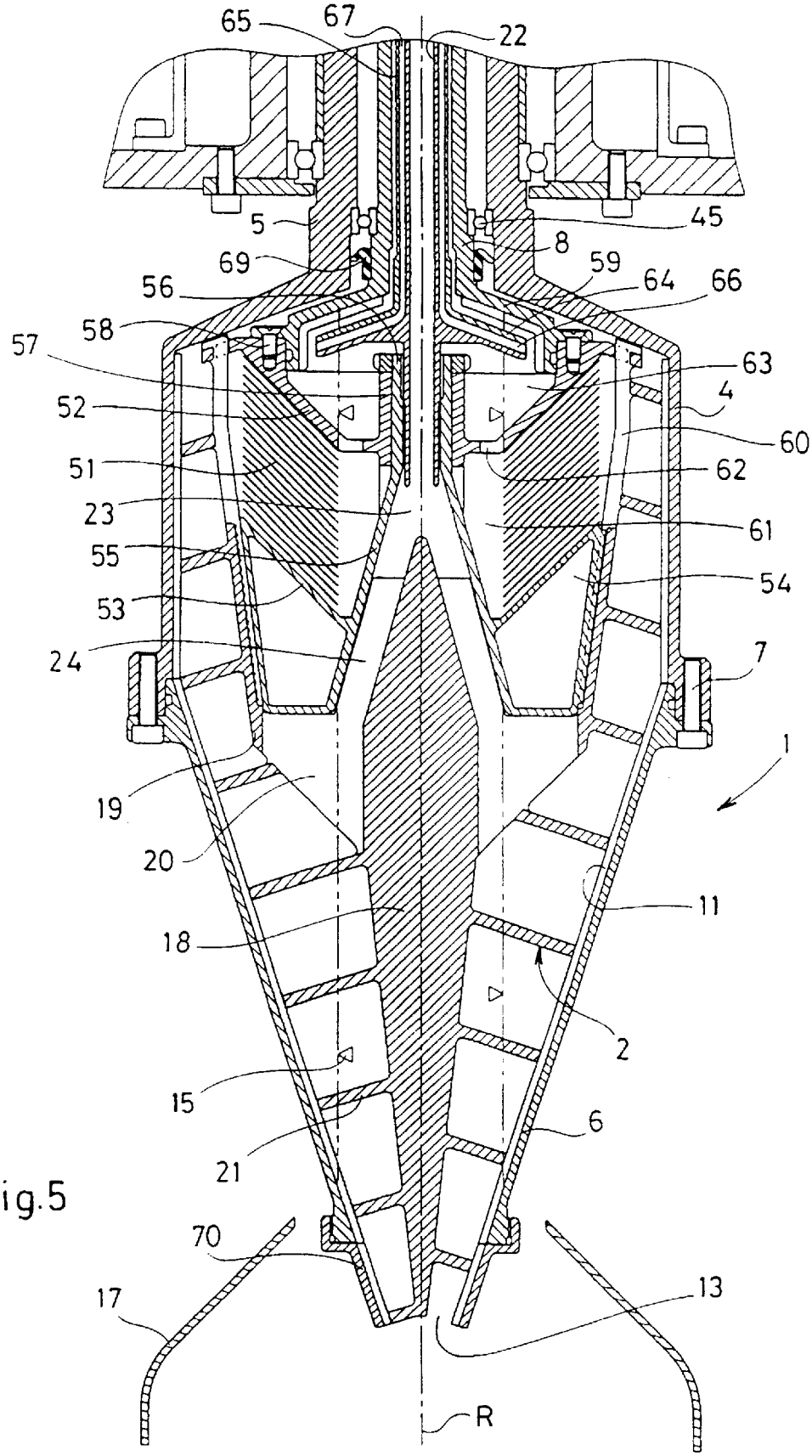
FIG. 5 shows the rotor and the screw conveyor of the centrifugal separator in FIG. 4 on a larger scale.

The FIGS. 4 and 5 show a second embodiment of the invention, which differs from the first embodiment only in what concerns certain parts of the rotor 1. Parts which are common in the two embodiments have been given the same reference numerals. The gear device 3 is similar in both embodiments.

In the embodiment according to the FIGS. 4 and 5 the rotor 1 includes a stack of frusto-conical separation discs 51. These are mounted coaxially with the rotor centrally in the cylindrical upper portion 4 thereof. The conical separation discs, which turn their base ends upwardly, are kept axially together between a conical upper supporting plate 52 and a hollow supporting body 53. A space 54 in the supporting body 53 may be filled with a material having a small density like the corresponding space 10 in the body 9 of the embodiment in FIG. 1. The supporting body 53 is supported through a conical partition 55 by a central sleeve 56, which extends through and is releasably connected with a surrounding sleeve 57 formed in one piece with the conical upper support plate 52.

By means of screws 58 the supporting plate 52 is connected with a conical plate 59, which is supported by the hollow shaft 8. Hereby, the shaft 8 supports also the separation discs 51 and the supporting body 53. In addition thereto, the shaft 8 supports the screw conveyor 2, which is releasably connected with the supporting body 53 and the supporting plate 52. In any case, the shaft 8 is connected with the screw conveyor 2 in a way such that a rotational movement can be transferred therebetween.

At its upper part the screw conveyor 2, in the vicinity of the rotor surrounding wall, is provided with openings 60 distributed around the stack of separation discs 51, so that liquid in the upper part of the rotor may flow inwardly towards the rotational axis R and between the separation discs 51. The separation discs 51 delimit between themselves separation spaces having small radial distances between adjacent separation discs.

Between the stack of separation discs 51 and the conical partition 55 there is formed a central space 61, which through holes 62 in the supporting plate 52 communicates with an outlet chamber 63 formed between the supporting plate 52 and the conical plate 59.

In the outlet chamber 63 there is arranged a stationary outlet member in the form of a paring disc 64, which is supported partly by the inlet pipe 22 and partly by a further pipe 65 surrounding the inlet pipe 22. The paring disc 64 forms several outlet channels 66, which open into a central annular channel 67 which in turn—above the cap 46—communicates with an outlet conduit 68 (see FIG. 4).

The inlet pipe 22 extends downwardly through the outlet chamber 63 and opens into the inlet passage 23 within the conical partition 55.

In this embodiment of the invention the level 15 of the free liquid surface formed in the rotor during operation is determined by the position of the radially outer edges around the holes 62 in the conical supporting plate 52. These edges will form an overflow outlet for liquid flowing from the central space 61 to the outlet chamber 63. This presupposes that the outlet member or paring disc 64 has enough capacity for discharging all of the liquid flowing into the outlet chamber 63. The liquid surface in the outlet chamber 63 then may be kept at a level radially outside the holes 62.

If desired, however, the outflow of liquid through the outlet 68 may be throttled more or less, which means that the free liquid surface in the outlet chamber 63 may be caused to take a position at a level closer to the rotational axis R. This level may be situated even radially inside of the outer edges of the holes 62 and, if so, this would mean that even the free liquid surface in the lower part of the rotor would be situated radially inside the shown level 15. Upon need, a variation of the throttling of the outflow through the outlet 68 may be accomplished during operation of the centrifugal separator in response to some sensed parameter, e.g. the dryness of the sludge leaving the rotor through the sludge outlet 13. Thus, the separating operation may be continuously controlled if needed.

For avoiding liquid flowing into the hollow rotor shaft 5 around the conveyor shaft 8 a sealing 69 is arranged in the area where the rotor 1 is connected with the rotor shaft 5.

To make it possible, when desired, that the free liquid surface in the rotor is maintained very close to the rotational axis R the lower rotor portion 6 may be provided with a conical piece 70. This piece may be applied onto the apex end of the rotor portion 6 by means of a simple screw connection. Pieces 70 of different sizes may be available so that the decanter centrifuge may be adapted to different needs. The effective outlet for sludge, thus, may be placed in this way at a desired distance from the rotational axis R substantially the whole way in to the rotational axis R without the axial outflow of sludge through the sludge outlet 13 being hindered by some rotating or stationary member.

The decanter centrifuge in the FIGS. 4 and 5 operates principally in the same way as the decanter centrifuge in the FIGS. 1–3. The added set of conical separation discs 51 makes possible, however, an even more effective separation of solids from a supplied mixture than the one obtainable without separation discs of this kind. It does not have to be conical separation discs. Other separation assisting means may be used either together with or instead of discs of this kind. In DE 48 615 some examples of other separation aiding means of this kind are shown. Even conventional filters may be used, if desired.

Especially when auxiliary separation aid means, such as separation discs of one kind or another, is needed it is advantageous to be able to keep the rotor filled with liquid substantially all the way to the rotational axis R. This may be possible by application of a conical piece 70 having an apex opening so small that only solids separated in the rotor are given a possibility to pass out through the apex opening. Then no air may force itself into the rotor through the sludge outlet 13. Hereby, the whole decanter centrifuge may be made as small and inexpensive as possible for the relevant separation duty.

The decanter centrifuge according to the invention is formed in a way making possible a very simple disassembling and reassembling thereof. Thus, essentially all parts of the rotor 1 and the screw conveyor are accessible and can be dismounted without the suspension device of the rotor and the screw conveyor having to be moved. However, if desired, some of the parts of the rotor and the screw conveyor, which are shown in the drawing for simplicity reasons formed in one piece, could be formed in several pieces releasably connected with each other.

As mentioned earlier, the liner 11 internally covering the rotor portions 4 and 6 may be exchangeable. If desired, conical liners of this kind may be formed in a way such that they suit in a rotor portion 6 independently of how large the sludge outlet 13 is, i.e. independently of whether a cone piece 70 is arranged or not and independently of how large a conical piece of this kind is. The liners, in such a case, are preferably formed completely conical, i.e. without any apex opening, after which an apex opening of a desired size is formed. Alternatively, as shown in the drawing, each conical piece 70 may be provided with a suitable liner.

In certain separation cases where a decanter centrifuge is used part of the separated sludge to be discharged from the rotor has a consistency such that it can be transported by means of the screw conveyor only with difficulty. In these cases a decanter centrifuge designed according to the invention may be operated completely filled with liquid, so that said part of the sludge is given a sufficient hydraulic assistance for its transportation to and out through the sludge outlet. Then it may be necessary to design the sealing 69 in a different way than can be seen from the drawing. For instance, a conventional so-called mechanical seal having plane sealing surfaces may be used.

Both of the above described embodiments of the invention are concerned with a decanter centrifuge for the separation of a liquid mixture only into two components, one liquid component and one sludge component. It is possible, of course, to use the invention even in a decanter adapted for separation of one liquid mixture into three (or more) components, e.g. one sludge component and two liquid components, such as oil and water. Then, the outlets for both of the liquid components should be placed at the upper end of the rotor and only the outlet for the sludge component should be placed at the lower end. Both of the liquid outlets may be formed either as open overflow outlets in accordance with FIG. 1, or as closed outlets, e.g. in the form of paring members, in accordance with FIG. 4. It is also possible to design the outlet for one of the liquid components as an overflow outlet and the outlet for the other liquid component as a paring member.

If at least one of the liquid outlets is formed as a paring member, it would be possible to accomplish a control of the separating operation during the operation of the decanter centrifuge, as has been described above with reference to the embodiment according to the FIGS. 4 and 5. Then, by proper throttling of the outflow of at least one of the liquid components the radial position may be set or controlled for an interface layer formed in the rotor between the two liquid components present therein.

Figure 6:
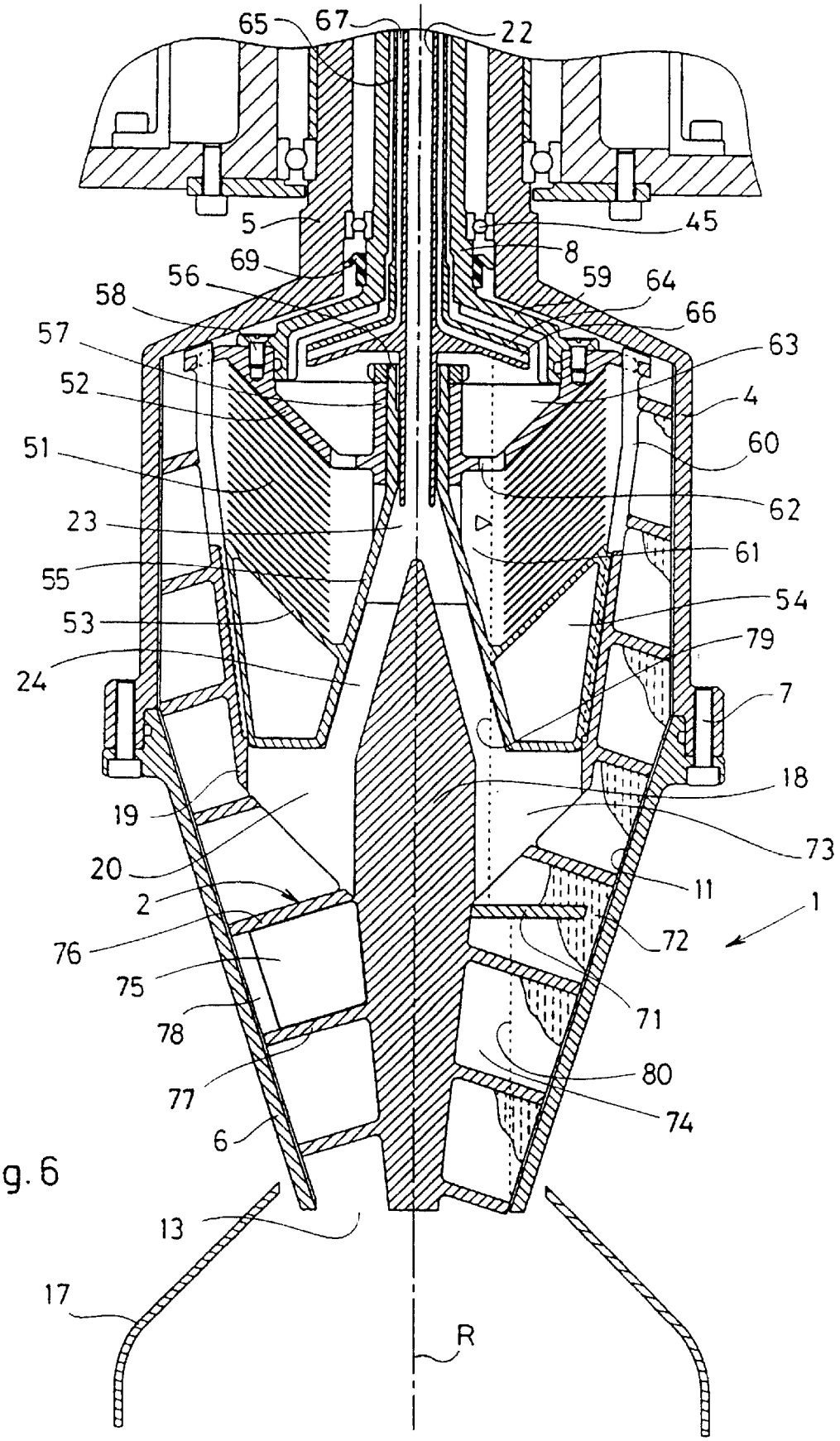
FIG. 6 shows a modification of the centrifugal separator according to FIG. 5.

FIG. 6 illustrates two alternative detail modifications of the centrifugal rotor according to FIG. 5; one is shown to the left and the other is shown to the right of the rotational axis R.

According to one of the detail modifications the core 18 of the screw conveyor supports an annular plane disc 71 (only one half of the disc is shown in FIG. 6) extending substantially perpendicularly to the rotational axis R towards the surrounding conical rotor portion 6. The disc 71 leaves closest to the rotor portion 6 an annular slot 72, which extends all the way around the rotational axis R.

The disc 71 forms a partition, which divides the interior of the rotor into a separation chamber 73 above the disc 71 and a sludge outlet chamber 74 below the disc 71. The two chambers 73 and 74 communicate with each other through the slot 72.

According to the other alternative detail modification the core 18 of the screw conveyor supports a disc 75, which extends between and is connected also with two axially opposing parts 76 and 77, respectively, of one and the same conveyor flight extending helically around the core 18. Even the disc 75 leaves closest to the rotor portion 6 a slot 78, which has the same function as the slot 72. Thus, also the disc 75 forms a partition, which divides the interior of the rotor into said separation chamber 73 and said sludge outlet chamber 74, which chambers communicate with each other only through the slot 78.

By means of the partition 71 or 75 it becomes possible to maintain a free liquid surface in the separation chamber 73 at a level 79 radially inside the level of the edge of the rotor portion 6, which forms the sludge outlet 13. The last mentioned level is designated 80 in FIG. 6. Hereby, it also becomes possible, as can be seen from FIG. 6, to give the stack of separation discs 51 an even smaller diameter than it has in the case as shown. As described earlier, a level movement radially inwardly of the liquid surface in the separation chamber 73 can easily be accomplished by throttling of the outlet of the separated liquid leaving through the channel 66 in the stationary paring member 64.

FIG. 6 illustrates how sludge having collected at the surrounding wall of the rotor is transported by the screw conveyor through the separation chamber 73, through the slot 72 (or 78) and through the sludge outlet chamber 74. It is important that the sludge transportation does not occur faster than such that the slot 72 is kept totally filled with sludge, because only then a free liquid flow can be avoided through the slot 72 from the separation chamber 73 to the sludge outlet chamber 74.

The sludge having been separated in the separation chamber 73 is subjected to a hydraulic pressure from liquid in the separation chamber, which compresses the sludge. The higher the liquid level is in the separation chamber, i.e. the closer the level 79 is to the rotational axis R, the more the sludge is compressed and, thus, the drier the sludge can be when it reaches the slot 72. If a certain dryness is desired in the sludge, when it leaves the rotor, this can thus be adjusted or controlled by displacement of the radial level 79 of the liquid surface in the separator chamber, i.e. by adjustment or control of the outflow of liquid through the stationary outlet member 64.

What is claimed is:

1. A centrifugal separator for separating solids from a liquid mixture, in which the solids in the form of particles are suspended in a liquid having a density smaller than that of the particles, which centrifugal separator includes a rotor (1) having a center axis (R), around which it is rotatable at a first speed, a screw conveyor (2), which is arranged in the rotor (1) and is rotatable around said center axis (R) at a second speed differing from said first speed, and a driving device, which is adapted for rotation of the rotor (1) at said first speed and the screw conveyor (2) at said second speed, the rotor (1) being rotatably supported only at one end through a rotor shaft (5), arranged so that the rotor center axis extends substantially vertically, the rotor (1) having an inlet for said mixture in the form of at least one inlet channel (22-24), which extends into the rotor at is said one end, a liquid outlet for separated liquid in the form of at least one outlet channel (12; 66-68), which extends out of the rotor at its said one end, and a sludge outlet (13) for separated solids situated at the opposite end of the rotor, the rotor including a conical portion (6), at the apex of which said sludge outlet (13) is situated, the screw conveyor (2) being formed for transportation of separated solids through said conical portion (6) of the rotor towards the sludge outlet (13), and the screw conveyor (2) being engaged for rotation with a conveyor shaft (8), which extends axially through the rotor shaft (5) and is coupled together with said driving device, and wherein the conveyor shaft (8) is connected with a supporting body (9), which is arranged within and coaxially with the rotor (1), and the screw conveyor (2) is releasably supported by the supporting body (9), the screw conveyor (2) being axially displaceable into and out of engagement with the supporting body (9).

2. A centrifugal separator according to claim 1, in which the conical portion (6) of the rotor is frustoconical and at its narrow end defines an axially directed central opening, the said sludge outlet (13) of the rotor being formed by this central opening.

3. A centrifugal separator according to claim 2, 1n which said central opening is free from stationary members.

4. A centrifugal separator according to claim 2, in which the conical portion (6) of the rotor at its narrowest end supports a conical piece (70), which is releasably connected with the conical portion (6) and has a central apex opening which is smaller than the central opening of the conical portion.

5. A centrifugal separator according to claim 1, in which said outlet channel (67) for separated liquid extends through the rotor shaft (5).

6. A centrifugal separator according to claim 5, in which said outlet channel (67) is formed by a stationary outlet pipe (65), which within the rotor (1) supports an outlet member (64).

7. A centrifugal separator according to claim 6, in which said outlet pipe (65) extends axially through the conveyor shaft (8).

8. A centrifugal separator according to claim 1, in which said inlet channel is formed by an inlet pipe (22), which extends axially through the conveyor shaft (8).

9. A centrifugal separator according to claim 8, in which a stationary outlet pipe (65), which supports an outlet member (64) within the rotor (1), extends axially through the conveyor shaft (8), said inlet pipe (22) extends axially through said stationary outlet pipe (65).

10. A centrifugal separator according to claim 1, in which the screw conveyor (2) extends around a space, which is axially open, so that the supporting body (9) is insertable thereinto when the screw conveyor (2) is brought axially into engagement with the body (9).

11. A centrifugal separator according to claim 10, in which the conveyor screw (2) and the supporting body (9) are formed for engagement with each other through axially extending splines.

12. A centrifugal separator according to claim 1, in which the conveyor screw (2) and the supporting body (9) are formed for engagement with each other through axially extending splines.

13. A centrifugal separator according to claim 1, in which several separation discs (51), which between themselves form separation spaces having small radial distances between adjacent separation discs, are mounted for rotation with the screw conveyor (2) within the rotor.

14. A centrifugal separator according to claim 13, in which the separation discs (51) are conical, stacked upon each other and placed coaxially with the rotor (1).

15. A centrifugal separator according to claim 14, in which the conical separation discs (51) each define a base end that is turned toward said one end of the rotor (1).

16. A centrifugal separator according to claim 14, in which the conveyor shaft (8) supports both said supporting body and said separation discs (51).

17. A centrifugal separator according to claim 16, in which the conveyor shaft (8) is connected with a supporting plate (52), the separation discs being arranged axially between said supporting plate and part of said supporting body.

18. A centrifugal separator according to claim 1, in which the rotor (1) is suspended in a way such that said rotor shaft (5) is situated at the upper end of the rotor and said sludge outlet (13) is situated at the lower end of the rotor.

19. A centrifugal separator according to claim 1, in which the screw conveyor (2) supports a partition, which divides the interior of the rotor into one separation chamber (73) and on sludge outlet chamber (74) and which at the surrounding wall of the rotor leaves a slot (72; 78), through which the two said chambers (73, 74) communicate with each other.

20. A centrifugal separator according to claim 19, in which a set of conical separation discs (51) is arranged coaxially with the screw conveyor (2) in said separation chamber (73).

21. A centrifugal separator according to claim 20, in which the separation discs (51) are mounted for rotation together with the screw conveyor (2).

22. A centrifugal separator according to claim 1, in which the inlet channel (22–24) extends axially through the supporting body (9).

23. A centrifugal separator according to claim 1, in which the supporting body (9) has an outer diameter substantially larger than that of said conveyor shaft (8).

24. A centrifugal separator according to claim 23, in which the supporting body (9) has axially extending splines on its outside, which are in engagement with corresponding splines formed on a surface of the screw conveyor (2) facing towards said center axis (R).

25. A centrifugal separator according to claim 23, in which the supporting body is made of plastic.

26. A centrifugal separator according to claim 23, in which the screw conveyor is made of plastic.

27. A centrifugal separator according to claim 23, in which the supporting body is annular.

28. A centrifugal separator according to claim 1, in which a snap lock device is arranged to fix the screw conveyor axially relative to the supporting body.

* * * * *